US007203457B1

(12) United States Patent
Wetzel

(10) Patent No.: US 7,203,457 B1
(45) Date of Patent: Apr. 10, 2007

(54) TUNING SYSTEM FOR ACHIEVING RAPID SIGNAL ACQUISITION FOR A DIGITAL SATELLITE RECEIVER

(75) Inventor: Daniel Thomas Wetzel, Indianapolis, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 499 days.

(21) Appl. No.: 10/031,176

(22) PCT Filed: Jul. 19, 2000

(86) PCT No.: PCT/US00/19617

§ 371 (c)(1),
(2), (4) Date: Jan. 16, 2002

(87) PCT Pub. No.: WO01/06650

PCT Pub. Date: Jan. 25, 2001

Related U.S. Application Data

(66) Substitute for application No. 60/144,465, filed on Jul. 19, 1999.

(60) Provisional application No. 60/144,458, filed on Jul. 19, 1999.

(51) Int. Cl.
*H04H 1/00* (2006.01)

(52) U.S. Cl. ..... 455/3.02; 455/318; 455/255; 455/265

(58) Field of Classification Search ..... 455/3.01, 455/3.02, 3.06, 3.04, 13.1, 13.2, 13.3, 12.1, 455/266, 200.1, 180.1, 180.3, 190.1, 191.1, 455/255, 260, 265, 313, 314, 315, 316, 3.2, 455/182.2, 192.2, 189.1, 196.1, 258, 259, 455/264, 318, 319, 192.3, 182.3; 348/726, 348/368; 375/344, 345, 317; 725/70, 68
See application file for complete search history.

(56) References Cited

U.S. PATENT DOCUMENTS

| | | | | |
|---|---|---|---|---|
| 4,713,689 A | | 12/1987 | Veillard | 358/146 |
| 5,325,188 A | | 6/1994 | Scarpa | 348/624 |
| 5,507,025 A | * | 4/1996 | Rodeffer | 455/266 |
| 5,570,136 A | | 10/1996 | Kim | 348/725 |
| 5,570,137 A | | 10/1996 | Goeckler | 348/726 |
| 5,594,938 A | | 1/1997 | Engel | 455/6.2 |
| 5,598,221 A | | 1/1997 | Miyahara et al. | 348/554 |
| 5,640,213 A | | 6/1997 | Miyahara et al. | 348/726 |
| 5,748,262 A | | 5/1998 | Boie | 348/726 |
| 5,774,195 A | | 6/1998 | Miyahara et al. | 348/726 |
| 5,786,870 A | | 7/1998 | Limberg | 348/607 |
| 5,801,790 A | | 9/1998 | Limberg | 348/607 |
| 5,844,948 A | * | 12/1998 | Ben-Efraim et al. | 375/344 |

(Continued)

FOREIGN PATENT DOCUMENTS

WO 97/38489 10/1997

*Primary Examiner*—Edward Urban
*Assistant Examiner*—John J. Lee
(74) *Attorney, Agent, or Firm*—Joseph J. Laks; Robert D. Shedd; Brian J. Cromarty

(57) ABSTRACT

A method and apparatus for compensating for frequency drift in an LNB by storing the frequency offset of each LNB with respect to each channel. When a channel is selected, a particular LNB is activated and the table of offset values is consulted. The offset value for the LNB and channel is used to tune the LNB to a frequency that is appropriate for receiving the selected channel.

9 Claims, 6 Drawing Sheets

U.S. PATENT DOCUMENTS

| | | | | |
|---|---|---|---|---|
| 5,852,476 | A | 12/1998 | Limberg | 348/725 |
| 5,893,025 | A | 4/1999 | Bessho et al. | 455/6.2 |
| 5,894,334 | A | 4/1999 | Strolle et al. | 348/725 |
| 5,898,455 | A * | 4/1999 | Barakat et al. | 455/190.1 |
| 5,940,737 | A * | 8/1999 | Eastman | 725/68 |
| 5,956,098 | A | 9/1999 | Mizukami et al. | 348/735 |
| 6,023,306 | A | 2/2000 | Limberg | 348/726 |
| 6,046,775 | A | 4/2000 | Jonnalagadda et al. | 348/461 |
| 6,539,068 | B2 * | 3/2003 | Hebron et al. | 375/346 |
| 6,600,730 | B1 * | 7/2003 | Davis et al. | 370/343 |
| 2002/0171584 | A1 * | 11/2002 | Walker et al. | 342/368 |

* cited by examiner

TUNING SYSTEM FOR ACHIEVING RAPID SIGNAL ACQUISITION FOR A DIGITAL SATELLITE RECEIVER

This application claims the benefit under 35 U.S.C. § 365 of International Application PCT/US00/19617, filed Jul. 19, 2000, which was published in accordance with PCT Article 21(2) on Jan. 25, 2001 in English; and which claims benefit of U.S. provisional applications Ser. Nos. 60/144,458 and 60/144,465, both filed Jul. 19, 1999.

FIELD OF THE INVENTION

The invention generally relates to satellite communications systems and, more particularly, the invention relates to satellite television receivers.

BACKGROUND INFORMATION

Satellite television receiving systems usually comprise an "outdoor unit" including a dish-like receiving antenna and a "block" converter, and an "indoor unit" including a tuner and a signal processing section (generally referred to as an integrated receiver decoder (IRD)). The block converter converts the entire range ("block") of relatively high frequency RF signals transmitted by a satellite to a more manageable, lower range of frequencies.

In a conventional satellite television transmission system television information is transmitted in analog form and the RF signals transmitted by the satellite are in the C (e.g., 3.7 to 4.2 GHz) and Ku (e.g., 11.7 to 14.2 GHz) bands. The RF signal received from the satellite by the antenna of the receiving system are converted by the block converter to the L band (e.g., 900 to 2000 MHz). An RF filter section of the tuner of the indoor unit selects the one of the RF signals received from the block converter corresponding to the selected channel, and a mixer/local oscillator section of the tuner converts the selected RF signal to a lower, intermediate frequency (IF) range for filtering and demodulation.

In newer satellite television systems, such as the DirecTV™ system operated by the Hughes Corporation of California, television information is transmitted in digital form. The RF signals are transmitted by the satellite in the Ku band, and are converted by the block converter to the L band. The frequency range of the RF signals transmitted by the satellite is somewhat smaller (e.g., between 12.2 and 12.7 GHz) than that for the analog satellite television system, and the frequency range of RF signals produced by the block converter is accordingly somewhat smaller (e.g., between 950 and 1450 MHz).

As in the analog satellite television receiving systems, the RF signal corresponding to the selected channel has to be reduced in frequency to an IF frequency range for filtering and demodulation. In a digital satellite receiver, in addition to the normal IF filtering for selecting the desired RF signal and rejecting unwanted RF signals, it is desirable that the IF filter perform what is known as "symbol shaping" to reduce decoding errors due to "inter-symbol interference" caused by bandwidth limitations.

The conversion stage of the block converter of the outdoor unit usually includes a local oscillator which is not stabilized against variations of temperature and age. The result is that the frequency of the local oscillator signal of the block converter changes, causing a corresponding change or offset of the frequencies of the carrier signals of the RF signals received by the tuner of the indoor unit. As a consequence, the frequency of the IF signal produced by the tuner also changes or is offset from its nominal value. If the frequency of the IF signal changes too far from its nominal value, the digital signals modulated on the IF signal cannot be properly demodulated and the information they represent cannot be properly reconstructed. To overcome this problem, the offset frequency is monitored and an offset added to nominal frequency command to change the local oscillator of the tuner to center the signal in the IF filter.

In U.S. patent application Ser. No. 09/155,025, entitled "Tuning System For Achieving Quick Acquisition Times For A Digital Satellite Receiver" filed in the US PCT Receiving Office of the US Patent and Trademark Office on April 5 for John Curtis, III and John Bohach, it is recognized that the RF signals received from the LNB (low noise block) and the corresponding IF signal produced by the tuner may be offset in frequency due to reasons other than a frequency drift of the oscillator of the LNB. More specifically, satellite transponder frequency adjustments may be made by the satellite transmission system operator to reduce the possibility of interference between carrier signals. For example, a transponder frequency may be changed by as much as +/−2 MHz. The transponder frequency adjustments cause the RF signals received from the LNB and the corresponding IF signal produced by the tuner to have a frequency offset.

Accordingly, the method and apparatus described in the Curtis et al. application concern provisions for tuning frequency offsets due to the adjustment of individual transponder frequencies by the satellite transmission system operator. These provisions allow the transmission frequencies of the transponders to be adjusted by the satellite transmission system operator without unduly increasing the time for the indoor unit to acquire the digital signal when a new channel is selected. Briefly, the tuning system measures and stores individual transponder originated frequency offsets. Any offset due to LNB frequency drift is added to all of the transponder frequency offsets as a "global" offset. An individual transponder offset is updated if it is not possible to tune a transponder frequency or if the successful acquisition required a frequency offset greater than a predetermined threshold or is a broad frequency search was required to acquire the signal.

To receive signals from multiple satellites, some receiver systems utilize multiple antennas in combination with multiple LNBs. Differing frequency drift in the various LNBs and frequency offset variations amongst satellites slows the signal acquisition time of the IRD. Limitations imposed on the amount of power that can be carried by the coaxial cable between the IRD and the LNB allow very little power to be sent. As such, only one or two LNB are able to be powered at any one time. Consequently, LNBs must be activated and deactivated to limit the power consumption of the LNBs. With each activation and deactivation the LNB oscillators are allowed to settle before the IRD is tuned. Thus, a substantial amount of time passes each time an LNB is activated. Furthermore, power for the LNB circuits is generally carried from the IRD to the LNBs via a coaxial cable. The amount of power that can be carried to the LNB is limited for safety reasons.

Therefore, there is a need in the art for a satellite receiver that rapidly acquires satellite signals that are received from multiple satellites.

SUMMARY OF THE INVENTION

The present invention provides a method and apparatus for compensating for frequency drift in one or more low noise blocks (LNBs) by storing a frequency offset (drift compensation) for each LNB with respect to each channel. This invention is particularly useful in a satellite television receiver system that uses a plurality of LNBs with one or more antennas. When a particular channel is selected, a particular LNB is activated and the table of offset values is consulted. The offset value for the LNB and channel is used to tune the receiver to a frequency that is appropriate for receiving the selected channel. As such, the receiver does not have to search to lock onto the signal from the selected LNB.

Additionally, in a multiple LNB system, one or more LNB's may be deactivated and require activation to be used. As such, when a channel handled by a particular deactivated LNB is selected, the LNB is activated. Upon activation the local oscillator within the LNB is not stable and will generally "slew" in frequency until reaching a stable nominal frequency. To decrease the satellite signal acquisition time, an integrated receiver decoder (IRD) tuner to which the LNB is connected is tuned while the LNB oscillator is stabilizing. As such, the tuner "frequency locks" to the "slewing" signal from the LNB and decodes the satellite signal as soon as the local oscillator signal is stable.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DESCRIPTION OF THE PREFERRED EMBODIMENT

The invention will be described with reference to a digital satellite television system in which television information is transmitted in encoded and compressed form in accordance with a predetermined digital compression standard, such as MPEG. MPEG is an international standard for the coded representation of moving picture and associated audio information developed by the Motion Pictures Expert Group. The DirecTV™ satellite television transmission system operated by the Hughes Corporation of California is such a digital satellite television transmission system.

In the transmitter, the television information is digitized, compressed and organized into a series or stream of data packets corresponding to respective video, audio, and data portions of the television information. The digital data is modulated on to a RF carrier signal in what is known as QPSK (Quaternary Phase Shift Keying) modulation and the RF signal is transmitted to a satellite in earth orbit, from which the signal is retransmitted back to the earth. In QPSK modulation, the phases of two quadrature phase signals, I and Q, are controlled in response to the bits of respective digital data streams. For example, the phase is set to 0 degrees (°) in response to a low logic level ("0"), and the phase is set to 180° in response to a high logic level ("1"). The phase shift modulated I and Q signals are combined and the result transmitted as a QPSK modulated RF carrier signal. Accordingly, each symbol of the modulated QPSK carrier indicates one of four logic states, i.e., 00, 01, 10 and 11.

A satellite typically includes a number of transponders for receiving and retransmitting respective modulated RF carriers. In a conventional terrestrial television system, each RF carrier or "channel" contains information for only one television program at a time. Accordingly, to view a program, only the corresponding RF signal needs to be selected. In a digital satellite television system, each modulated RF carrier carries information for several programs simultaneously. Each program corresponds to groups of video and audio packets which are identified by a unique header appended to the packets which identifies the program. Accordingly, to view a program, both the corresponding RF signal and the corresponding packets need to be selected.

Figure 1:
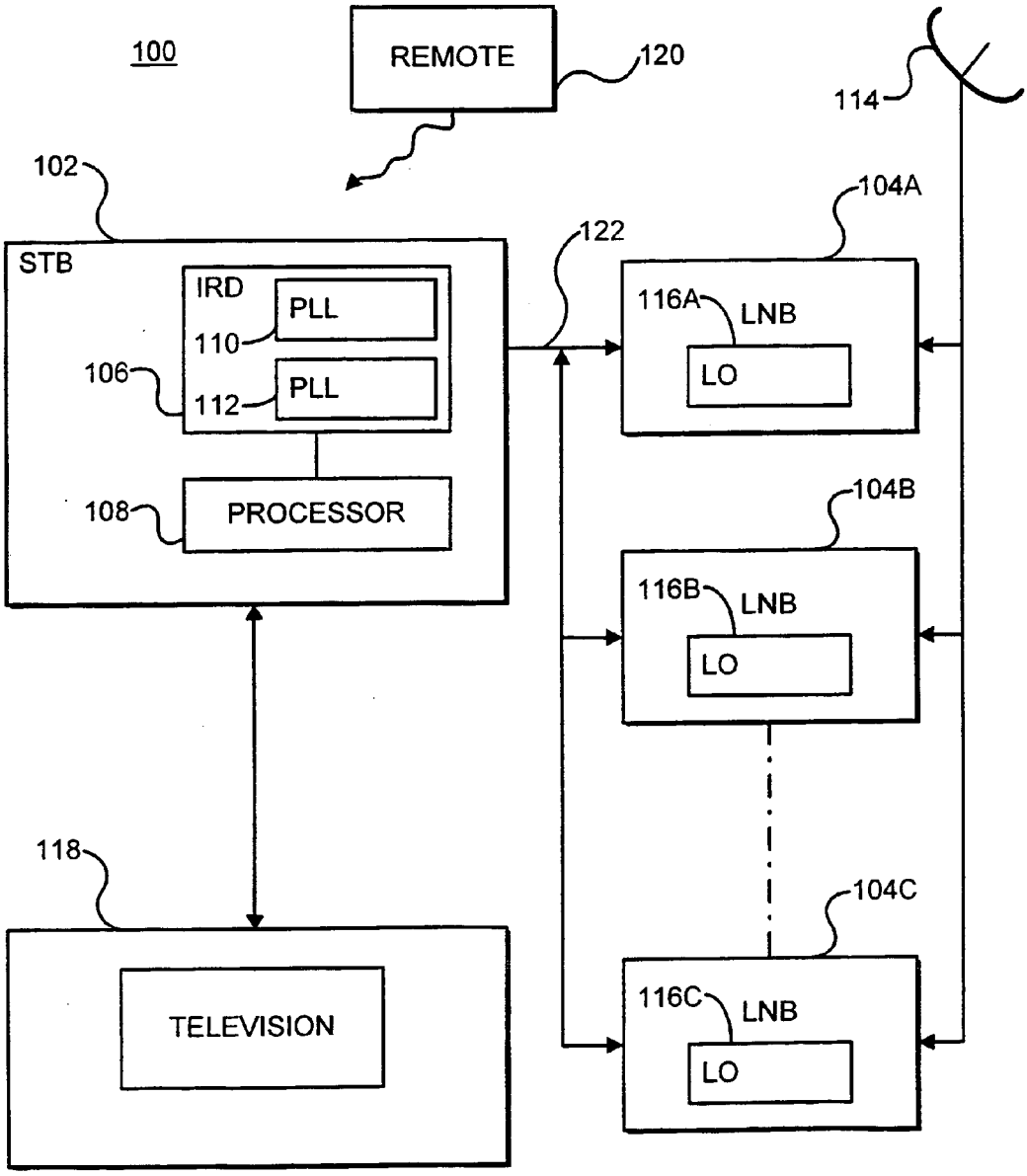
FIG. 1 is a simplified block diagram of a satellite television receiver.

FIG. 1 illustrates a satellite television receiver system 100 comprising a typical set top box (STB) 102, multiple low noise blocks (LNB) 104A–C and one or more antennas 114. STB 100 comprises an integrated receiver decoder (IRD) 106 and a processor 108. The IRD 106 comprises a PLL (phase lock loop) 110 and local oscillator (LO) 112. The processor 108 controls the IRD 106 and controls the selection of LNB 104A–C to be used. The IRD 106 will switch between LNBs 104A–C depending upon the satellite transponder that is necessary to receive a selected channel. Each LNB 104A–C comprises a local oscillator (LO) 116A–C that is tuned to a particular frequency to enable the IRD to receive and decode the selected channel. STB 102 is coupled to a television receiver 118 for reproducing the audio and video signals received from a selected LNB 104A–C. Channel selection is generally provided in a well known manner through an infrared remote control 120.

Generally, the LNBs 104 receive power from a DC voltage supplied by the STB 102 via a coaxial cable 122. Due to safety regulations, the amount of power that can be supplied to the LNBs is limited. As such, only one or two LNBs can be activated (powered) at any one time. Thus, when two or more LNBS are used, one of the LNBs is deactivated until the LNB is used. When required, an activation signal is sent through the coaxial cable to the deactivated LNB and one of the active LNBs. In response to the control signal, one LNB is activated and another is deactivated. The invention, as described below, simultaneously tunes both the IRD LO 112 and the LNB LO 116 while the LNB LO 116 is settling. In addition, the invention tunes the IRD LO 112 using a frequency offset that is recalled from a frequency offset table. The frequency offset is added to the nominal LO frequency to provide an expected LO frequency based upon the frequency drift and transporter frequency offset experiences during the prior use of the LNB. These features of the invention, enable the system 100 to rapidly acquire a satellite signal using a recently activated LNB 114.

Figure 2:
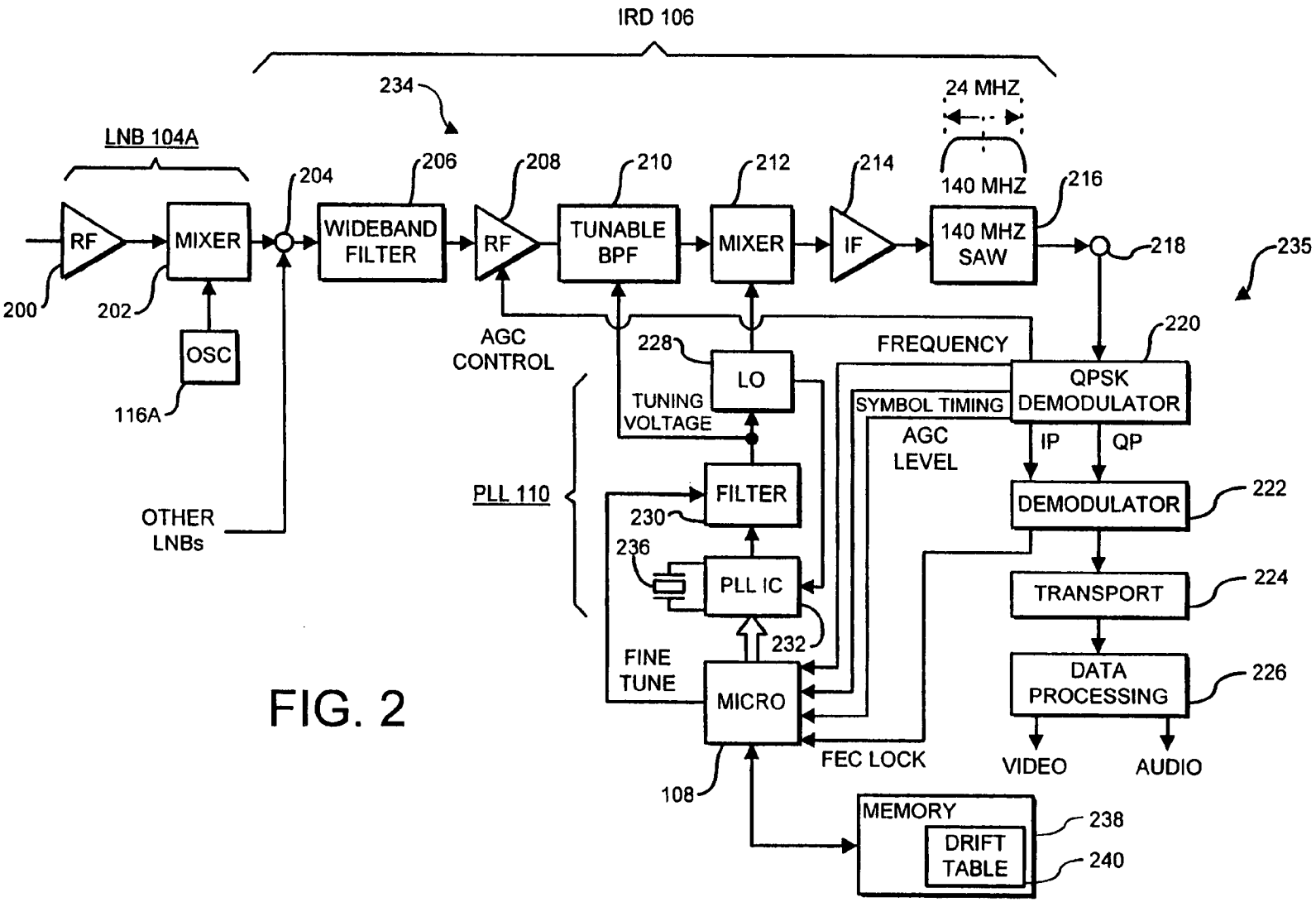
FIG. 2 is a detailed block diagram of a digital satellite television receiver including a tuning system which may utilize the invention.

FIG. 2 depicts a detailed block diagram of one LNB 104A and the IRD 106. RF signals modulated with digital signals representing video and audio information which have been transmitted by a satellite (not shown) are received by the LNB 104A. The relatively high frequency received RF signals (e.g., in the Ku frequency range between 12.2 and 12.7 GHz) are converted by a LNB, for example, LNB 104A, including a RF amplifier 200, a mixer 202 and an oscillator 116A, to relatively a lower frequency RF signals (e.g., in the L band between 950 and 1450 MHz). Amplifier 200 is a "low noise" amplifier and is therefore block converter 104A is often referred to by the initials "LNB" for "low noise block converter". The antenna 114 and LNB 104A are included in a so called "outdoor unit" of the receiving system 100. The remaining portion of the receiver is included in a so called "indoor unit".

Indoor unit includes the IRD 106 that tunes, demodulates and decodes the received signals from port 204. The IRD 106 comprises a tuner 234 for selecting the RF signal which contains the packets for the desired program from the plurality of RF signals received from LNB 104A and for converting the selected RF signal to a corresponding lower, intermediate frequency (IF) signal. The present invention is concerned with controlling the tuner 234 and will be described in detail below.

The remaining portion 235 of IRD 106 demodulates, decodes and decompresses the digital information carried in QPSK modulation form by the IF signal to produce streams of digital video and audio samples corresponding to the desired program, and, thereafter, converts the digital sample streams to respective analog video and audio signals suitable for reproduction or recording. More specifically, a QPSK demodulator 220 demodulates the IF signal to produce two pulse signals IP and QP which contain respective streams of data bits corresponding to the data represented by the phase shift modulated I and Q signals generated in the transmitter. A decoder 222 organizes the bits of the IP and QP signals into data blocks, corrects transmission errors in the data blocks based on error codes which have been embed in the transmitted data at the transmitter, and reproduces the transmitted MPEG video and audio packets. The video and audio packets are routed by a transport unit 224 to respective video and audio sections of a data processing unit 220 where they are decompressed and converted to respective analog signals. A microprocessor 108 controls the operation of various sections of IRD 106. However, only the control signals generated and received by microprocessor 108 with which the invention is directly concerned are indicated in FIG. 2.

The digital satellite television receiver described so far is similar to the RCA™ type digital satellite system television receiver commercially available from Thomson Consumer Electronics, Inc. of Indianapolis, Ind.

As noted earlier the present invention is concerned with controlling the tuner 234. Tuner 234 receives the RF signal provided by LNBS 104A–C at an input 204. The RF input signals are filtered by wideband filter 206, amplified by RF amplifier 208, and filtered by tunable bandpass filter 210. Tunable bandpass filter (BPF) 210 selects the desired RF signal and rejects unwanted RF signals. The resultant RF signal is coupled to a first input of mixer 212. A local oscillator signal produced by local oscillator (LO) 228 is coupled to a second input of mixer 212. The output of mixer 212 is amplified by amplifier 214 and coupled to the input of IF filter 216 comprising a SAW device. The output of IF filter 216 is coupled to output 218 of tuner 234.

The frequency of LO 228 is controlled by PLL arrangement 110 comprising PLL integrated circuit (IC) 232, external frequency reference crystal 236 and external filter network 230. The frequency of the LO signal is controlled by PLL 110 in accordance with instructions generated by microprocessor 108.

The carriers of the RF signals transmitted by the satellite and received by antenna 114 have very stable frequencies which remain at "nominal" values. Therefore, as long as the frequency of oscillator 116A of LNB 104A is stable and remains at its nominal value, the frequencies of carriers of the RF signals received by tuner 234 will be at their nominal values. Unfortunately, the frequency of oscillator 104A can change with time and temperature. The frequency offset of the oscillator 104A with respect to its nominal frequency cause corresponding offsets of carrier frequencies of the RF signals received by tuner 234. To compensate for these frequency offsets, the frequency of LO 228 of tuner 234 is changed under the control of microprocessor 108 in response to frequency status information received from QPSK demodulator 220. As shall be described below, the microprocessor 108 uses drift tables 240 that are stored in memory to derive the frequency offset compensation. A drift table is created for each LNB.

Figure 3:
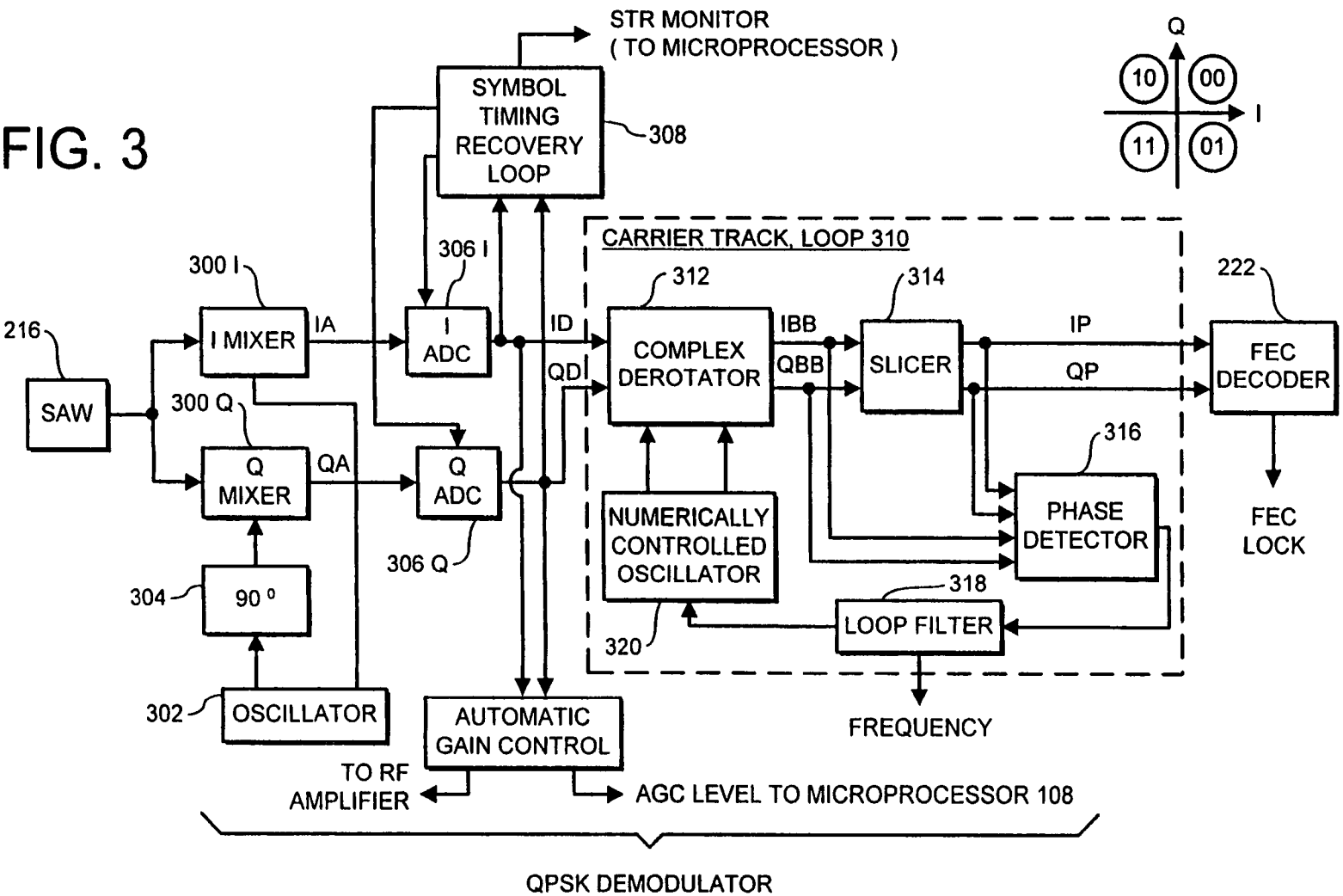
FIG. 3 is a block diagram of a digital data demodulator for use in the satellite receiver shown in FIG. 1.

As shown in FIG. 3, the IF signal produced by IF SAW filter 216 is coupled to respective first inputs of mixers 300I and 300Q. The letters "I" and "Q" signify "in-phase" and "quadrature". The output signal of relatively stable frequency oscillator 302 is directly coupled to mixer 300I and indirectly coupled to mixer 300Q via 90 degree (90°) phase shift network 304. Mixer 300I produces an "in-phase", "near" baseband (much lower frequency) version (IA) of the IF signal, while mixer 300Q produces an "quadrature", near baseband version (QA) of the IF signal, which is shifted 90 degrees with respect to the "in-phase" signal (IA). The letter "A" signifies "analog".

The IA and QA signals are coupled to respective analog-to-digital converters (ADCs) 306I and 306Q. Analog-to-digital converters 306I and 306Q also receive a clock signal from "symbol timing recovery loop" 308 and produce respective series of digital samples ID and QD. The letter "D" signifies "digital". Symbol timing recovery (STR) loop 308 includes a controlled oscillator (not shown) from which the clock signal for ADCs 306I and 306Q is derived. The controlled oscillator is controlled by a hybrid (part digital and part analog) phase locked loop (not shown) so that the digital samples are synchronized with the incoming symbol rate and phase. The analog signals can be viewed as a stream of pulses. The function of STR loop 308 is to phase lock the clock so that the ADC samples the analog signal at the peaks of the pulses. In other words, STR loop 308 synchronizes the sampling operation of ADCs 306I and 306Q with the arrival of each received symbol.

The ID and QD signals are also processed by a "carrier track loop" (CTL) 310. CTL 310 demodulates the digital sample signals ID and QD so as to form respective pulse signals IP and QP. The letter "P" signifies "pulse". Although the signals have been demodulated (broken down into IA and QA components), the signals were demodulated with a nonsynchronous carrier. Since the demodulating carrier was not synchronized with the transmitted carrier, the constellation will still be rotating. It is typically called a Near Baseband Signal at this point. Once it has been derotated, it is referred to as a "Base-Band Signal". Thus the IBB and QBB nomenclature on the output of Derotator 312. The baseband signals can be plotted on a I vs. Q plot which creates the "constellation" diagram. The baseband signal is input to slicer 314 which estimates which of the four constellation points was transmitted. Each of the IP and QP pulse signals contain a series of pulses corresponding to data bits. The data bits have either a logic low ("0") level or logic high ("1") level corresponding to 0° and 180° phase shifts, respectively, of the I and Q signals of the transmitted QPSK RF carrier. The IP and QP signal components are coupled to decoder 222, where the data bits are formatted into packets and forward error correction (FEC) performed.

CTL 310 includes complex derotator 312, slicer 314, numerically controlled oscillator (NCO) 320, phase detector 316, and the loop filter 318. Complex derotator 312 is a complex multiplier that derotates the spinning constellation to output a stable constellation. The derotation is accomplished by multiplying the digital input ID and QD signals by the estimated sine and cosine of the estimated frequency offset and phase. The estimated frequency offset is the rate at which the near baseband signal is spinning. How this estimated offset is generated is described below.

Slicer 314 takes the derotated constellation and outputs decisions based on the quadrant of the input. Each I, Q pair out of slicer 314 is the estimate of which symbol was transmitted. Phase detector 316 takes the input and output of slicer 314 and generates a phase error signal for each symbol. This phase error signal is applied to loop filter 318. Loop filter 318 controls NCO 320 and provides an estimate of the offset frequency. This estimate is available to microprocessor 108.

A frequency error, for example, due to a LNB derived frequency offset of the selected RF signal, causes a so-called "rotation" or "spinning" of the position of the two-bit demodulated data of the QPSK signal with time. The direction of rotation is dependent on whether the frequency offset is positive or negative. As is shown in FIG. 3, the data constellation for QPSK modulation has four points corresponding to the four possible logic combinations (00, 01, 10 and 11) of the respective two possible logic levels represented by the two possible phase shift values of the I and Q signals. Phase detector 316 measures the position of the demodulated data relative to the ideal position in the data constellation. To correct for data rotation and tilt, the frequency, and thus the phase, of NCO 320 is changed by loop filter 318 in response to the output signal of phase detector 316 until the rotation stops and the tilt is eliminated.

With this rotation stopped, the constellation is stabilized and CTL 310 is considered "locked." Under this steady state condition, loop filter 318 has correctly estimated the frequency and phase shifts that are needed to derotate the data so that the constellation is successfully stabilized. Loop filter 318 has a proportional and integral paths which are summed together to form the control for NCO 320. The value of the integral path (which integrates the phase error) represents the frequency offset which cause the "rotation". This value is available to microprocessor 108 as the FREQUENCY signal shown in FIGS. 1 and 2. Microprocessor 108 compares successive samples of the FREQUENCY signal to determine if the constellation has been stabilized. If the difference in successive samples is small, the demodulation is recognized as "LOCKED".

Under this steady state condition, the demodulated data IP and QP is reliable and passed on to FEC decoder 222. During the acquisition of a channel, if the current frequency of the tuner LO 228 does not allow a successful lock of CTL 310, then the microprocessor 108 will adjust the frequency until either a LOCKED condition is found or a suitable frequency range has been covered. The entire signal acquisition process will be more fully detailed in the description of the flow chart in FIG. 4.

Within limits, CTL 310 can demodulate the QPSK data even when the frequency of the IF signal, and therefore the frequency of the IA and QA signals, is incorrect or offset. However, if the frequency offset is too great, a portion of the frequency spectrum of the IF signal will fall outside of the passband of SAW filter 216 due to the shift of the IF signal relative to the center frequency of SAW filter 216. This will cause a degradation of the signal to noise ratio of the receiver. Accordingly, as noted above, microprocessor 108 monitors a FREQUENCY signal generated by CTL 310 to indicate the frequency offset of the IF signal. As the frequency offset caused by the LNB drift changes, CTL 310 tracks the changes and FREQUENCY signal monitored by microprocessor 108 is updated. Upon the next channel acquisition, microprocessor 108 will use the last recorded frequency offset to provide a more accurate placement of LO 228. This should allow the signal to be quickly acquired without having to search by moving the frequency of the LO 228 again. If the frequency offset becomes so large as to cause degradation in the reliability of the demodulated data, eventually, FEC decoder 222 will be unable to correct the errors and break lock. Microprocessor 108 will request a reacquisition of the same channel and the last frequency offset will again be used to accurately place the frequency of LO 228 for a quick reacquisition.

As noted above, the derotated data streams, IP and QP are processed by FEC decoder 222 shown in FIG. 3. The function of FEC decoder 222 is to correct errors incurred in the transmission of the data. For the decoder to be able to correct errors, the demodulated signal must be stabilized. Additionally, in order to correct the data, FEC decoder 222 must be set for the same code rate as the transmission code rate and synchronized to the packet boundaries. The FEC LOCK signal generated by FEC decoder 222 and monitored by microprocessor 108 indicates if all the above conditions are met and FEC decoder 222 is successfully passing error free data. For example, the FEC LOCK signal has a low logic level when FEC decoder 222 cannot correct the data, and the FEC LOCK signal has a high logic level when FEC decoder 222 can correct the data.

The FEC LOCK signal is used as the final determination of whether tuner 234, QPSK demodulator 220, and FEC decoder 222 are successfully locked because CTL 310 can falsely stabilize on a "false lock point". At a "false lock point", the constellation does not appear to be spinning. But the constellation is actually rotating 90 degrees (or a multiple of 90 degrees) per symbol. Since there is another constellation point 90 degrees away, it appears to be stable. The "false lock points" occur at multiples of the symbol rate divided by four. When CTL 310 is stabilized at a false lock point, the FEC decoder will not be able to decode the data. Thus, the FEC LOCK signal will remain in a low logic level (unlocked).

The acquisition of signals which have been described so far only concern frequency offsets due to LNB frequency drifts. As noted above, frequency offsets may also be due to other reasons. More specifically, satellite transponder frequency adjustments may be made by the satellite transmission system operator to reduce the possibility of interference between carrier signals. For example, a transponder frequency may be changed by as much as +/−2 MHz. The transponder frequency adjustments cause the RF signals received from the LNB and the corresponding IF signal produced by the tuner to have a frequency offset. The following aspects of the present tuning system concern provisions for tuning frequency offsets due to the adjustment of individual transponder frequencies by the satellite transmission system operator. These provisions allow the transmission frequencies of the transponders to be adjusted by the satellite transmission system operator without unduly increasing the time for the indoor unit to acquire the digital signal when a new channel is selected.

Without the provisions for tuning frequency offsets due to the adjustment of individual transponder frequencies by the satellite transmission system operator, the tuning system operates in the following way when a new transponder frequency is selected:

The frequencies of the signals being transmitted are usually known before hand and stored in a table (referred to as the "baseline frequency" plan). Then during operation, when a transponder is selected for tuning, the baseline frequency is retrieved from the table and a frequency offset is added. This offset as previously described is determined from the offset required to lock up on the previous transponder. This offset is referred to as a "global offset" because it applies globally to all transponders. The cause of the global offset is due to any frequency drift in oscillators which are common to the communications path. For example, if the down converter oscillator in the LNB (Low Noise Block down converter) is off by 3 MHz due to it being a chilly night, then all the transponders will be shifted 3 MHz below their baseline frequencies. This global drift is initially found by a search algorithm which steps the tuner across a specified frequency range while trying to acquire the signal (referred to as the "find drift" algorithm). Once the find drift algorithm finds a signal, the exact offset of the signal can be used to initialize the global drift for future tuning. Once the global drift is initialized, the value is tracked by monitoring the FREQUENCY signal in CTL 310. Every time a new transponder is requested, the microprocessor updates the global drift by adding the last value of the FREQUENCY signal.

With the normal system described above, if a transponder was moved from its baseline frequency plan, it would result in slow channel change times when tuning that transponder and any subsequently tuned transponder. This would be due to the fact that the above system assumes the offset is global to all transponders. For example, as for a system with 10 transponders, evenly spaced 30 MHz apart starting at 1000 MHz, the baseline frequency plan for the transponders would be the one shown in following TABLE 1. If the LNB offset causes a 2 MHz shift in the frequencies, the transponders are located at the frequencies shown in the "with LNB offset" column. If the satellite transmission system operator offsets transponder 3 from the others by 1.5 MHz, then the last column in TABLE 1 shows where each transponder is located.

TABLE 1

| Transponder Number | Baseline Frequency | Frequency with LNB offset | Frequency with #3 moved and LNB offset |
|---|---|---|---|
| 1 | 1000 MHz | 1002 MHz | 1002 MHz |
| 2 | 1030 MHz | 1032 MHz | 1032 MHz |
| 3 | 1060 MHz | 1062 MHz | 1060.5 MHz |
| 4 | 1090 MHz | 1092 MHz | 1092 MHz |
| 5 | 1120 MHz | 1122 MHz | 1122 MHz |
| 6 | 1150 MHz | 1152 MHz | 1152 MHz |
| 7 | 1180 MHz | 1182 MHz | 1182 MHz |
| 8 | 1210 MHz | 1212 MHz | 1212 MHz |
| 9 | 1240 MHz | 1242 MHz | 1242 MHz |
| 10 | 1270 MHz | 1272 MHz | 1272 MHz |

With respect to the exemplary situation shown in the foregoing TABLE 1, the global drift would be initialized to 2 MHz if transponder 1 is selected. Since all transponders other than transponder 3 are correctly tuned, the tuner would be tuned to the desired signal. However, if transponder 3 is selected, the tuner would be tuned to the frequency 1.5 MHz higher than the one required and, therefore, the signal would not be acquired until the search algorithm began to widen its search by stepping LO 911. This would result in finding the signal, but at a new offset of 0.5 MHz. This new offset would be assumed to be the new global offset and would cause the next transponder to be selected being also mistuned. As a result, the tuner has to again go into the widened search. Therefore, every time transponder 3 is selected, an undesirably slower channel change occurs.

This problem is further exacerbated with multiple LNBs that are tuned to receive signals from transponders in other satellites. As such, changing channels may cause a frequency shift due to a transponder offset across satellites.

The present invention deals with the provisions for independent tuning frequency offsets due to the adjustment of individual transponder frequencies by the satellite transmission system operator and decreasing frequency acquisition time. The following description is made with respect to FIG. 4.

Figure 4:
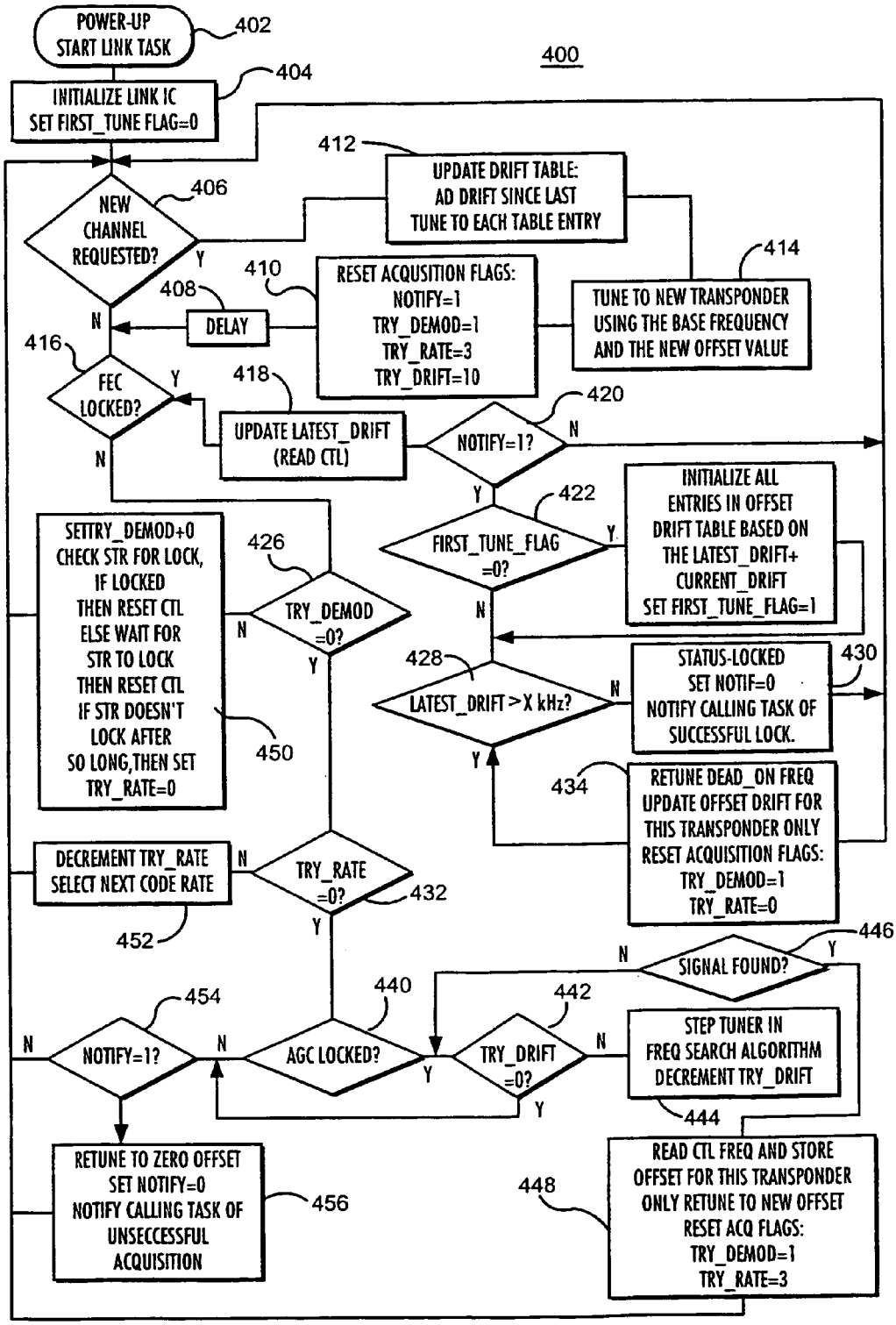
FIG. 4 is a flow chart of the acquisition routine used to control the tuning system shown in FIG. 1 in accordance with an aspect of the present invention.

The flow chart in FIG. 4 depicts a method 400 having five main scenarios that need to be described: (1) the maintenance mode (viewing a channel); (2) a normal channel change; (3) the transponder has been only slightly moved and does not require a broad search; (4) the transponder has been moved or is not at the offset or rate that was expected and does require a broad search; (5) the initial tuning of a transponder at start up of the box; and (6) an unsuccessful channel change.

As shown in FIG. 4, the system powers up at step 402 and proceeds to initialize the link integrated circuit in step 404.

(1) Maintenance mode. Steady state operation occurs when a user is viewing a channel and not surfing or experiencing any type of rain fade. Under this scenario, the following path would be taken: the "New Channel requested?" (step 406) would be answered No. This would lead to the "FEC Locked?" (step 416) (FEC—Forward Error Correction—locked means the decoder is successfully decoding the bitstream without errors) question, which would be answered Yes since everything is properly locked. In step 418, the FREQUENCY signal and the Carrier track loop (CTL) is read. This value is stored in the variable "Latest_drift" for the LNB then being used and represents the frequency drift that has occurred since the last tune (assuming the last tune put the tuner within one tuner step of the correct frequency). Since it is in steady state, the Notify flag will not be set at step 420 (the flag is cleared after notification of a successful lock) and the routine returns to check if a channel change request has occurred and the cycle repeats at step 406.

(2) Normal Channel change. Under a normal channel change scenario, the new transponder that is to be acquired is within a tuner step of the expected frequency. The expected frequency is base frequency plus an offset stored in a drift table for the LNB to be useful. The drift table contains the individual offset frequency for each transponder in each available satellite that can be accessed by a particular LNB. The method 400 follows the following path: the "New Channel Request" is answered Yes at step 406 and proceeds to step 412. The variable "Latest_drift" (last updated in the maintenance mode above) is added to each element of the drift table corresponding to the LNB being used. This makes the assumption that the drift that has occurred on the previous transponder since the last tune is applicable to all transponders and is typically due to temperature and aging drift of the LNB LO (similar to the normal systems tracking of a global drift).

Next, at step 414, the tuner is commanded to the new transponder frequency which is the sum of the base frequency plus the newly updated offset frequency from the drift table. Then, at step 410, the status flag is cleared, the acquisition flags are set including the notify flag. After a short delay at step 408, the FEC is queried for lock at step 416. The delay allows enough time for the FEC to lock if the tuner is properly placed and the correct code rate is selected. Under a normal channel change, the FEC will be locked at this point and the path will follow the Yes branch to step 418. The frequency offset is read again (and should be within the incremental frequency step of the tuner LO under this scenario) and stored as Latest_drift for the presently used LNB. Now the Notify flag is checked and, at step 420, will follow the Yes path as the Notify Flag is "1". The method 400 proceeds to step 422. At step 422, the First_tune_flag is queried and should not be set since the IRD step has previously been locked in this scenario, therefore method 400 proceeds to 428. At 428, the value of Latest_drift is compared to a frequency threshold which is approximately an incremental tuner step. Again, under this scenario, it is assumed that the offset is within the threshold and therefore method 400 follows the No path.

At step 430, the link is successfully locked and the routine notifies the software task that requested the channel change, that the link is ready. The Notify flag is cleared. The path then rejoins the maintenance path to 406 and will follow the maintenance cycle until another channel change is requested or a disturbance causes the FEC to break lock.

Notice in this path (406, 416, 420, 422, 428, 430 back to 406) the acquisition flags are never used, because the acquisition was successful without readjusting the tuner frequency.

(3) Channel change with minor adjustment to transponder frequency. Under this scenario, the transponder being acquired is close but not exactly where (in frequency) the drift table predicts. The frequency is close enough that the demodulation and FEC can still lock, but deemed to be far enough off that the individual transponder offset will be corrected in the drift table for the LNB that is presently being used. The path followed is identical to the above (case 2) with the exception of the Latest_drift being outside the threshold at step 428. Therefore, the routine executes step 434.

At step 434, the value of Latest_drift is added to the new transponders entry in the drift table for the LNB being used. Then this new offset is used to place the tuner exactly on the signal—center the signal in the IF SAW). To get to this point in the routine, the FEC must have been locked and thus the code rate must have been correct and therefore the try_rate flag is set to zero. Since the tuner is being moved, the demodulation could have trouble and the try_demod flag is set at step 434 to give the tuner an extra chance to attain lock if needed. Method 400 returns to step 406 and will fall through to check the FEC lock. Under this scenario, the FEC should lock and this time follow the path of a normal channel change to step 418, as in (2), with the Latest_drift being within the threshold.

(4) Channel change with wide frequency search required. In this scenario, the transponder being acquired is far enough away from the predicted frequency value that the method 400 must search for the signal by stepping the tuner. However, before the frequency search begins, the method 400 check for Symbol Timing Recovery (STR) loop lock, resets the Carrier track loop (CTL) in case the loop was in a false lock, and the method checks each code rate for the FEC, and checks the AGC for stability to determine if there is a signal available to be acquired. If these corrective actions do not allow for a FEC lock, then the frequency search is conducted. This is a last resort because the search is relatively time consuming. This is also the reason for the tracking of individual offsets for transponders, to avoid this time consuming search under normal channel change conditions.

The scenario starts off as a normal channel change, the drift table of the present LNB is updated at step 412, the tuner is tuned to the predicted frequency, flags are reset, but after the delay at step 408, the FEC is still not locked at step 416. At step 416, the corrective actions start. Following the No path out of the "FEC Locked" decision at step 416, the status flag is UNLOCKED, so method 400 follows the No path to step 426. But the "try_demod" flag is set, so the try_demod flag is not equal to zero and at step 450 the routine clears the Try_demod flag and checks the symbol timing recovery (STR) for lock. The STR lock is evaluated by comparing consecutive reads of the STR loop filter to an allowable delta. When the STR is unlocked, the filter will be ramping and the unlock condition is easily detected. If the STR is locked then the CTL (Carrier track loop) is reset to allow another chance at a clean lock.

If the STR is not locked, then it is periodically checked until it has been given enough time to ramp through all possible values. If the STR locks within that time, then just as above, the CTL is reset. If the STR does not lock within the time period, then the try_rate flag is cleared at step 450 (there is no use in trying the other code rates if the symbol timing can not lock). Method 400 returns to step 406 to check for a new channel change request and if none, method 400 checks to see if the corrective action was successful resulting in a FEC lock. If FEC is still unlocked, then the No path is again followed, but this time the "Try_demod" flag is clear, so it falls through to check the "Try_rate" flag at step 432. If the STR was locked then this flag will still be set and not equal zero. Thus the No path at step 432 is followed and method 400 proceeds to step 452. At step 452 the Try_rate flag is decremented and the FEC code rate is changed to the next rate. In the example, the "try_rate" flag is initialized to the number three, so three rates will be tried before falling through to the AGC check at step 440. After each rate, the routine returns to step 406 to check for a new channel request or to see if the FEC locked.

If the FEC lock is not found at step 416, 426 and 432 are no, the AGC is checked for lock at step 440. Again, lock is determined by comparing consecutive samples of the AGC loop filter. The AGC is checked for lock to speed up the customer's installation. If there is no signal present, then the AGC will not lock, and there is no use in wasting time searching in frequency. For this scenario at step 440, the AGC should be locked and the "try_drift" variable will be checked at step 442. At step 444, while the try_drift variable is still positive, the tuner will be stepped through a set of positions to cover a predetermined pattern. At each step, Try_drift will be decremented and the algorithm will check for STR and CTL lock ("signal found?") at step 446.

At step 444 first the STR is checked in a similar manner to that described above in the Try_demod portion. Once the STR is locked, the CTL is reset and checked for lock. Again the CTL lock is a determined by comparing the differentiation of the frequency indication from the loop filter to a fixed threshold. Unless both STR and CTL are declared locked within a certain time at step 446, the No path is followed and the next tuner location will be tried until either a signal is found or try_drift=0. At step 446, if both STR and CTL are declared locked within the time allowed, then the signal is considered "found" and method 400 follows the Yes path to step 448.

At step 448, the CTL frequency is summed with the tuner step position and that is stored in the drift table for that transponder. The tuner is retuned to this new offset and the acquisition flags are set to repeat the "try_demod" and the "try_rate" portions. Subsequently the routine returns to step 406 to check for new channel request and to see if the FEC is locked at step 416. Once the correct frequency offset and rate are discovered, the FEC should lock and the rest of the normal channel change path is run.

At step 410, the "try_drift" variable is initialized to 10 because there are 10 tuner positions (bands) that are searched. The frequencies that are searched allow for locating a signal that is offset by both the maximum LNB temperature and aging spec and for the maximum individual transponder offset allowed of the uplink provider. As an example, the LNB is specified to be with in +/−5 MHz of the desired frequency and the uplink provider was allowed to shift individual transponder frequencies up to +/−2 MHz, so the algorithm searched +/−7 MHz.

(5) Upon initial tuning of a transponder. The scenario is similar to that of (4) in that the offset frequency of the transponder is unknown or incorrect. The only difference is that once the FEC is Locked, this time the "First_tune_flag" will be set and step 424 will be executed. At step 424, all entries in the drift table are initialized to the offset found for the first transponder. This includes the Latest_drift read in step 418 and the current drift which is the value determined in step 448. Then the "First_tune_flag" is cleared so this initialization is not done again. The path then continues as a normal channel change as in (2).

(6) Unsuccessful acquisition. During an unsuccessful acquisition, all the Try_demod, try_rate, and Try_drift are eventually zeroed due to either trying that portion, or it being cleared due to another prerequisite. An example was mentioned in (4) above, when in Try-demod at step 426, if the STR doesn't lock at step 450 then the try_rate is automatically zeroed. Thus at step 454 once the routine has all the "try" variables zeroed and if the Notify flag is set, then, at step 456, the tuner is returned to zero offset for that transponder, the Notify flag is cleared and the software task that requested the transponder is notified of the unsuccessful acquisition. Method 400 will continue to cycle through checking for a new channel request and FEC lock.

What has been described so far deals specifically with how the frequency offsets for individual transponders are handled. In a normal system, only a single frequency offset is tracked or monitored and that offset is applied to all transponders equally. The method and apparatus similarly tracks the frequency offset during viewing and applies that offset to all transponders, but keeps separate values for each transponder so that each transponder may be separately recorded if required. The above scenarios 3 and 4 are examples of when a transponder offset is individually adjusted. The key factor is when a transponder is acquired at a position other than the predicated offset, then only that transponder's offset is updated. It should also be noted that the method and apparatus which have been described so far will only require the longer tune time for a transponder shifted from the base plan on the first acquisition of that transponder since the transponder has been shifted. After that the offset should be recorded and rapid signal acquisition after a channel change will occur.

In most cases, receiving signals from more than one satellite requires that there be more than one LNB 104A–C. Each LNB 104A–C has it's own local oscillator (LO) 116A–C. The LOs 116A–C will drift in frequency as the outdoor temperature changes. When the LOs 116A–C drift in frequency, the signals received by the IRD 106 also drift. This drift needs to be tracked by the IRD 106 in order to ensure that the channel change time is minimized. The tuning control system in a typical satellite receiver can track slow changes in the oscillator frequency, but cannot acquire signals with an initially large frequency offset. As an example, consider a user who tunes to one transponder and stays on that transponder for a period of time. During that time, the outside temperature heats up, and one of the LNB's LOs 104A–C, increases in frequency by 500 kHz. Typically, the communications hardware will have no problem tracking the slowly moving LO 104A–C. However, if the user changes transponders without taking into account the 500 kHz that the LO has moved, the channel change time will be lengthened while the IRD 106 searches for the new transponder frequency using a second LNB. The IRD has knowledge of how far the LO has moved, the 500 kHz can be added onto the transponder's frequency offset before tuning to that transponder. Using this method, the IRD should immediately lock onto the signal and minimize the channel change time. This same concept should desirably be applied when using multiple LNBs.

There are several methods that can be used to further optimize acquisition time when tuning to transponders that are on different satellites, i.e., using different LNBs and switching amongst LNBs. Each method has merits, and combining them can be used to achieve the best signal acquisition result.

1. If on LNB A and the frequency has drifted by an amount X, add X to the offset for LNB A before switching to LNB B. This will ensure that the last known frequency offset for LNB A is accurate.
2. If on LNB A and the frequency has drifted by an amount X, add X to the offset of LNB B before switching to LNB B. This will account for the fact that any change in temperature that has moved the LO in LNB A will also affect the frequency of LNB B in a similar manner.
3. If for a particular system, it is found that the drift of LNB A is independent of the drift of LNB B (or C or . . . ), do not add the drift of LNB A to the last known drift of LNB B. Such a case may be applicable when all of the LNBs are not constantly powered.
4. If on LNB A and switching to LNB B and the initial acquisition fails, try the frequencies immediately surrounding the best-guess frequency determined by (2) or (3) before sweeping the entire allowable frequency range.

These features could be used in any application where there are multiple antennas/multiple reception points.

There are limitations to how much power a satellite receiver can deliver to a plurality of LNBs (e.g., LNBs 104A–C) via a coaxial cable. For a typical satellite receiver 100, this means that only one LNB can be powered at a time. When switching from a transponder on one satellite to a transponder on another satellite, the previously unpowered LNB must be given some time for it's local oscillator to settle in frequency, i.e., a stabilization period. This stabilization period increases the overall tuning time. Because the LNB's settling time is greater than the time required for the IRD to achieve lock, the receiver 100 first activates the selected LNB and simultaneously locks the frequency of the IRD's local oscillator to the signal from the LNB.

Figure 5:
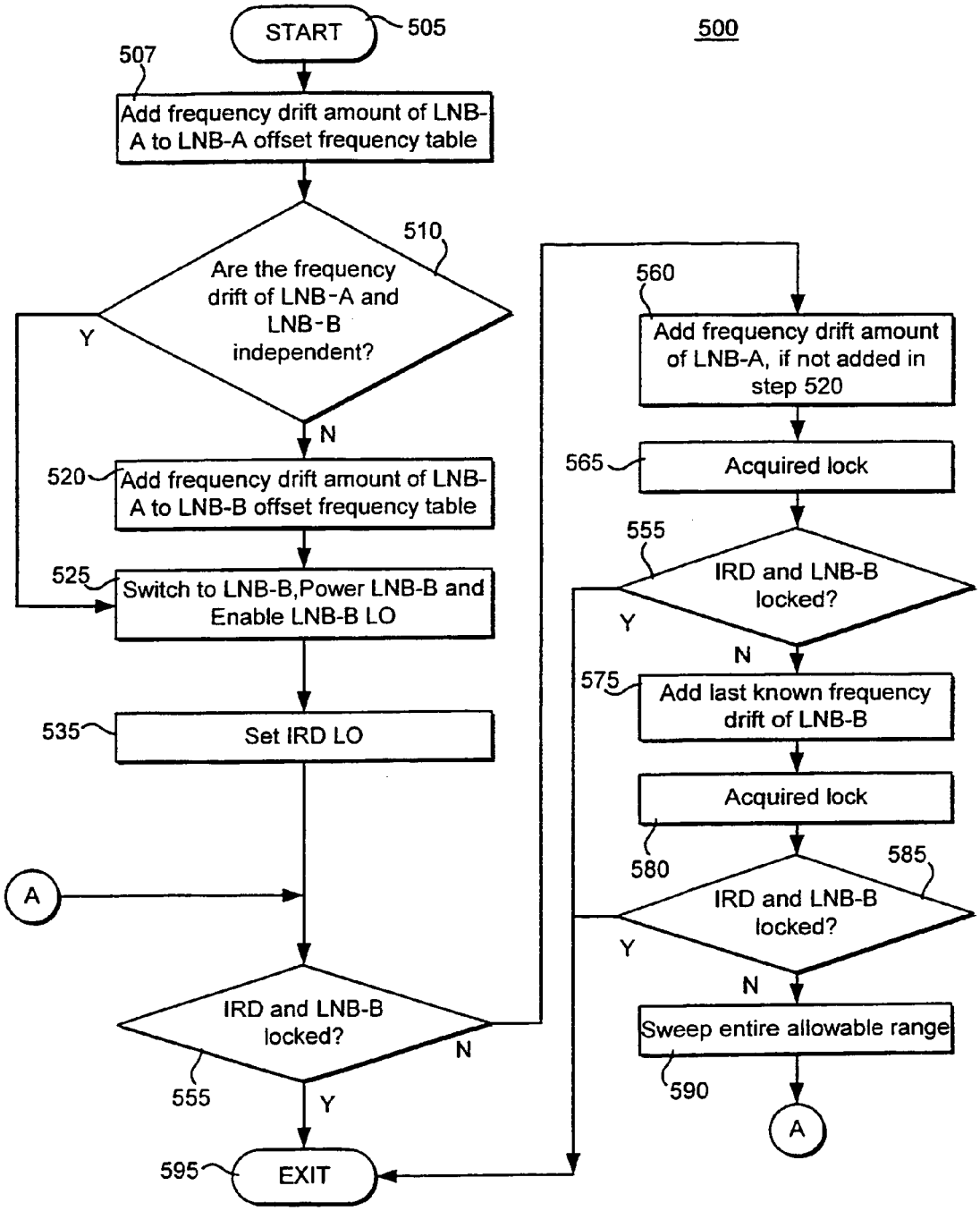
FIG. 5 is a flow diagram of a method to achieve fast signal acquisition using multiple LNBs.

FIG. 5 is an illustration of a method to achieve rapid signal acquisition when switching from one LNB (e.g., 104A) to a deactivated LNB (e.g., 104B). The method 500 is entered at step 505 when a switch between LNBs 104A and 104B is activated by processor 108. For example, assuming that the initial conditions of the system included STB 100 coupled to LNB-A 104A as shown in FIG. 1. Processor 108 initiates a change to LNB-B 104B and activates LNB-B 104B. At step 510, the LNBs 104A and 104B are compared by corresponding drift data to check if they move independently when temperatures or other global anomalies occur that can shift each respective LO 116A and 116B. This step may be pre-determined so that the query could be answered by accessing a flag. The flag would be set if the LNBs drift independently and unset if they drift dependently. If the drift of LNB-A 104A is independent of the drift of LNB-B 104B then method 500 proceeds to step 525 described below. If the drift between LNB-A 104A and LNB-B 104B are similar, then method 500 proceeds to step 515.

At step 515, the drift table for LNB-A 104A is updated by the current drift amount of LNB-A 104A. At step 520, the drift amount of LNB-A 104A is added to the drift table for LNB-B 104B. Generally, the drift amount for LNB-A is updated for the LNB-A drift table prior to switching to another LNB. At step 525, LNB-B is powered and coupled into the tuner 234. Upon powering the LNB, the LNB-B LO 116B is enabled. The PLL LO 228 is set to the proper frequency to lock with LNB-B 104B. After waiting a pre-determined amount of time to allow LNB-B OSC 116B to settle, the method 500 proceeds to step 535. At step 535, the IRD Lo is tuned. Establishment of lock is checked at step 555. If lock has been established, the method exits at step 595. In the event lock has not been established, method 500 proceeds to sweep ranges starting about the offset drift of LNB-A 104A. Lock is checked at step 555. If lock was achieved, then method 500 exits at step 595. If lock was not achieved then method 500 proceeds to step 575 to begin an acquisition sweep using the offset drift value of LNB-B 104B. Lock is checked at step 555. If lock was achieved, then method 500 exits at step 595. If lock was not achieved method 500 proceeds to 590 to sweep the entire allowed range to establish the frequency lock as discussed with respect to FIG. 4. Lock is checked at 555. If lock was not achieved method 500 returns to step 545 to reestablish the lock process.

To further enhance the signal acquisition time, the IRD does not wait for the LNB LO to stabilize. Typically, a satellite receiver system, due to power constraints, may only send enough power to the LNBs through the coaxial cable to power one or two LNBs. If a plurality of LNBs are used, some of them must be deactivated while others operate. Consequently, when the deactivated LNB is activated, the LO requires about 100 mSec to stabilize. As such, the IRD PLL 110 will lock on the "slewing" signal from the LNB as the LNB oscillator stabilizes after activation.

Figure 6:
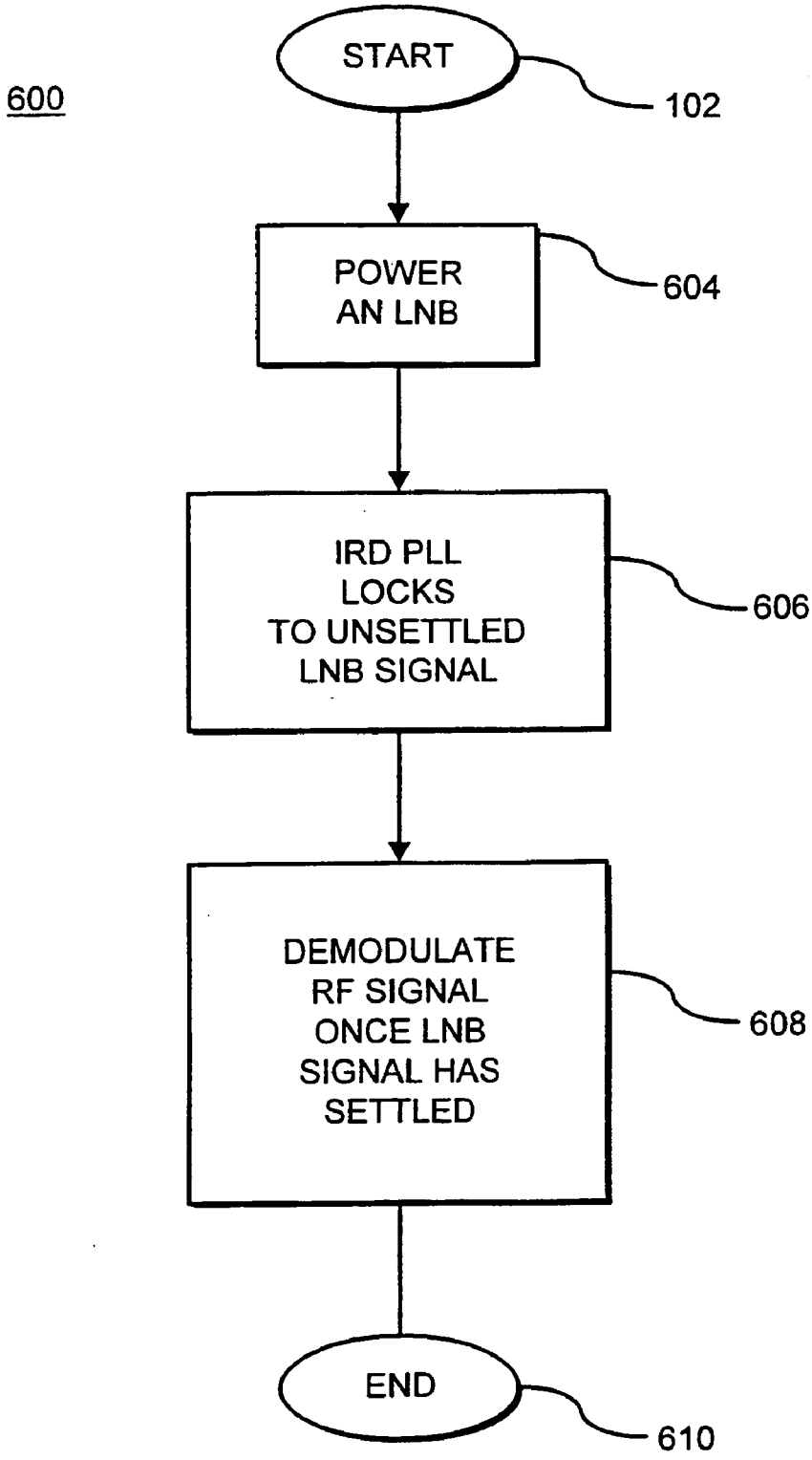
FIG. 6 is a flow diagram of a method of achieving fast signal acquisition when LNBs require selective activation and deactivation.

FIG. 6 depicts a flow diagram of a method 600 representing a process for simultaneously tuning the IRD and the LNB. The method 600 begins at step 602 and proceeds to step 604. At step 604, a selected LNB is activated. While the LNB LO is stabilizing, at step 606 the IRD PLL locks to the "slewing" LNB output signal and tracks that signal. As such, demodulation of the signal can begin at step 608 as soon as the LNB LO is stable. The method ends at step 610.

While the present invention has been described in terms of a specific embodiment, it will be appreciated that modifications may be made which will fall with in the scope of the invention.

What is claimed is:

1. A method for acquiring satellite signals comprising:

a) receiving a request to switch from a first low noise block to a second low noise block;

b) switching from the first low noise block to the second low noise block;

c) recalling from memory a tuner frequency value associated with said second low noise block, wherein said tuner frequency value comprises an low noise block base frequency and a local oscillator frequency offset value;

d) tuning a frequency for receiving a selected channel with a tuner using the local oscillator frequency offset value; and e) locking said tuner to said second low noise block.

2. The method of claim 1 wherein the local oscillator frequency offset value compensates for frequency drift in the second LNB.

3. The method of claim 1 wherein the local oscillator frequency offset compensates for a frequency adjustment in a satellite transponder.

4. The method of claim 1 wherein the local oscillator frequency offset compensates for a frequency adjustment in a satellite transponder and frequency drift in the second LNB.

5. The method of claim 1 further comprising activating the second LNB while tuning said tuner frequency.

6. The method of claim 1 wherein the local oscillator frequency offset for the second LNB is derived from a frequency drift of the first LNB.

7. Apparatus for acquiring satellite signals comprising:

a tuner coupled to first and second LNBs comprising a local oscillator having a frequency equal to a base frequency plus either a first local oscillator frequency offset value or a second local oscillator frequency offset value;

a memory, coupled to said tuner, for storing said first local oscillator frequency offset value for the first low noise block and said second local oscillator frequency offset value for the second low noise block, said tuner being tuned to a frequency using said second local oscillator frequency offset value and is locked to the second low noise block upon switching from the first low noise block to the second low noise block thus enabling acquisition of a satellite signal.

8. The apparatus of claim 7 wherein the first and second local oscillator frequency offset values represent the respective frequency drifts of the first and second LNBs.

9. The apparatus of claim 7 wherein said first local oscillator frequency offset value comprises a local oscillator frequency offset value for each transponder associated with the first LNB and said second local oscillator frequency offset value comprises a local oscillator frequency offset value for each transponder associated with the second LNB.

* * * * *